US009004866B2

(12) United States Patent
Lee et al.

(10) Patent No.: US 9,004,866 B2
(45) Date of Patent: Apr. 14, 2015

(54) TURBINE BLADE INCORPORATING TRAILING EDGE COOLING DESIGN

(75) Inventors: Ching-Pang Lee, Cincinnati, OH (US); Glenn E. Brown, West Palm Beach, FL (US); Benjamin E. Heneveld, Newmarket, NH (US)

(73) Assignees: Siemens Aktiengesellschaft, München (DE); Mikro Systems, Inc., Charlottesville, VA (US)

( * ) Notice: Subject to any disclaimer, the term of this patent is extended or adjusted under 35 U.S.C. 154(b) by 407 days.

(21) Appl. No.: 13/311,630

(22) Filed: Dec. 6, 2011

(65) Prior Publication Data

US 2013/0142666 A1 Jun. 6, 2013

(51) Int. Cl.
*F01D 5/18* (2006.01)

(52) U.S. Cl.
CPC ..... *F01D 5/187* (2013.01); *F01D 5/186* (2013.01); *F05D 2240/122* (2013.01); *F05D 2240/304* (2013.01)

(58) Field of Classification Search
CPC ... F01D 5/186; F01D 5/187; F05D 2240/122; F05D 2240/304
USPC ..... 415/115; 416/96 R, 96 A, 97 R
See application file for complete search history.

(56) References Cited

U.S. PATENT DOCUMENTS

| | | | | |
|---|---|---|---|---|
| 4,236,870 | A | 12/1980 | Hucul, Jr. et al. | |
| 5,246,340 | A * | 9/1993 | Winstanley et al. | 416/97 R |
| 5,263,820 | A * | 11/1993 | Tubbs | 416/97 R |
| 5,468,125 | A * | 11/1995 | Okpara et al. | 416/97 R |
| 6,142,734 | A * | 11/2000 | Lee | 416/97 R |
| 6,254,346 | B1 | 7/2001 | Fukuno et al. | |
| 6,439,847 | B2 | 8/2002 | Taeck | |
| 7,128,533 | B2 | 10/2006 | Liang | |
| 2004/0219017 | A1 * | 11/2004 | Liang | 416/97 R |
| 2005/0111981 | A1 * | 5/2005 | Davison et al. | 416/97 R |
| 2010/0074762 | A1 | 3/2010 | Liang | |
| 2011/0171023 | A1 * | 7/2011 | Lee et al. | 416/1 |

FOREIGN PATENT DOCUMENTS

| | | | |
|---|---|---|---|
| EP | 0475658 | A1 | 9/1991 |
| GB | 2260166 | A | 4/1993 |
| WO | 2011050025 | A2 | 4/2011 |

OTHER PUBLICATIONS

Roy, et al, "Designing a Turbine Blade Cooling System Using a Generalised Regression Genetic Algorithm", CIRP Annals, 2003, vol. 52/1, p. 415-418.

* cited by examiner

*Primary Examiner* — Christopher Verdier

(57) ABSTRACT

A turbine blade (10) including an airfoil (12) having multiple interior wall portions (70) each separating at least one chamber from another one of multiple chambers (46, 48, 50, 58, 60). In one embodiment a first wall portion (70-2) between first and second chambers (60, 52) includes first and second pluralities of flow paths (86P, 86S) extending through the first wall portion. The first wall portion includes a first region $R_1$ having a first thickness, t, measurable as a distance between the chambers. One of the paths extends a first path distance, d, as measured from an associated path opening (78) in the first chamber (60), through the first region and to an exit opening (82) in the second chamber (52) which path distance is greater than the first thickness.

15 Claims, 5 Drawing Sheets

TURBINE BLADE INCORPORATING TRAILING EDGE COOLING DESIGN

FIELD OF THE INVENTION

The invention relates to turbine blades and vanes having air-foil structures which provide cooling channels within the trailing edges.

BACKGROUND OF THE INVENTION

A typical gas turbine engine includes a fan, compressor, combustor, and turbine disposed along a common longitudinal axis. Fuel and compressed air discharged from the compressor are mixed and burned in the combustor. The resulting hot combustion gases (e.g., comprising products of combustion and unburned air) are directed through a conduit section to a turbine section where the gases expand to turn a turbine rotor. In electric power applications, the turbine rotor is coupled to a generator. Power to drive the compressor may be extracted from the turbine rotor.

With the efficiency of a gas turbine engine increasing with operating temperature, it is desirable to increase the temperature of the combustion gases. However, temperature limitations of the materials with which the engine and turbine components are formed limit the operating temperatures. Airfoils of turbine blades and vanes are exemplary. The term blade as used herein refers to a turbine blade or vane having an airfoil. That is, the airfoil may be a part of a rotor (rotatable) blade or a stator (stationary) vane. Due to the high temperature of the combustion gases, airfoils must be cooled during operation in order to preserve the integrity of the components. Commonly, these and other components are cooled by air which is diverted from the compressor and channeled through or along the components. It is also common for components (e.g., nozzles) to be cooled with air bled off of the fan rather than the compressor.

Effective cooling of turbine air-foils requires delivering the relatively cool air to critical regions such as along the trailing edge of a turbine blade or a stationary vane. The associated cooling apertures may, for example, extend between an upstream, relatively high pressure cavity within the airfoil and one of the exterior surfaces of the turbine blade. Blade cavities typically extend in a radial direction with respect to the rotor and stator of the machine.

It is a desire in the art to provide increasingly effective cooling designs and methods which result in more effective cooling with less air. It is also desirable to provide more cooling in order to operate machinery at higher levels of power output. Generally, cooling schemes should provide greater cooling effectiveness to create more uniform heat transfer or greater heat transfer from the airfoil.

Ineffective cooling can result from poor heat transfer characteristics between the cooling fluid and the material to be cooled with the fluid. In the case of airfoils, it is known to establish film cooling along an exterior wall surface. A cooling air film traveling along the surface of an exterior wall can be an effective means for increasing the uniformity of cooling and for insulating the wall from the heat of hot core gases flowing thereby. However, film cooling effectiveness is difficult to maintain in the turbulent environment of a gas turbine.

Consequently, airfoils commonly include internal cooling channels which remove heat from the pressure sidewall and the suction sidewall in order to minimize thermal stresses. Achieving a high cooling efficiency, based on the rate of heat transfer, is an important design consideration in order to minimize the volume of air diverted from the compressor for cooling. By way of comparison, the aforementioned film cooling, providing a film of cooling air along outer surfaces of the air-foil, via holes from internal cooling channels, is somewhat inefficient due to the number of holes needed and the resulting high volume of cooling air diverted from the compressor. Thus, film cooling has been used selectively and in combination with other cooling techniques. It is also known to provide serpentine cooling channels within a component.

However, the relatively narrow trailing edge portion of a gas turbine airfoil may include up to about one third of the total airfoil external surface area. The trailing edge is made relatively thin for aerodynamic efficiency. Consequently, with the trailing edge receiving heat input on two opposing wall surfaces which are relatively close to each other, a relatively high coolant flow rate is desired to provide the requisite rate of heat transfer for maintaining mechanical integrity. In the past, trailing edge cooling channels have been configured in a variety of ways to increase the efficiency of heat transfer. For example U.S. Pat. No. 5,370,499, incorporated herein by reference, discloses use of a mesh structure comprising cooling channels which exit from the trailing edge.

The present invention increases heat transfer efficiency and uniformity of cooling in the trailing edge of a turbine airfoil.

BRIEF DESCRIPTION OF THE DRAWINGS

The invention is explained in the following description in view of the drawings wherein.

Like reference numbers are used to denote like features throughout the figures.

DETAILED DESCRIPTION OF THE INVENTION

Figure 1:
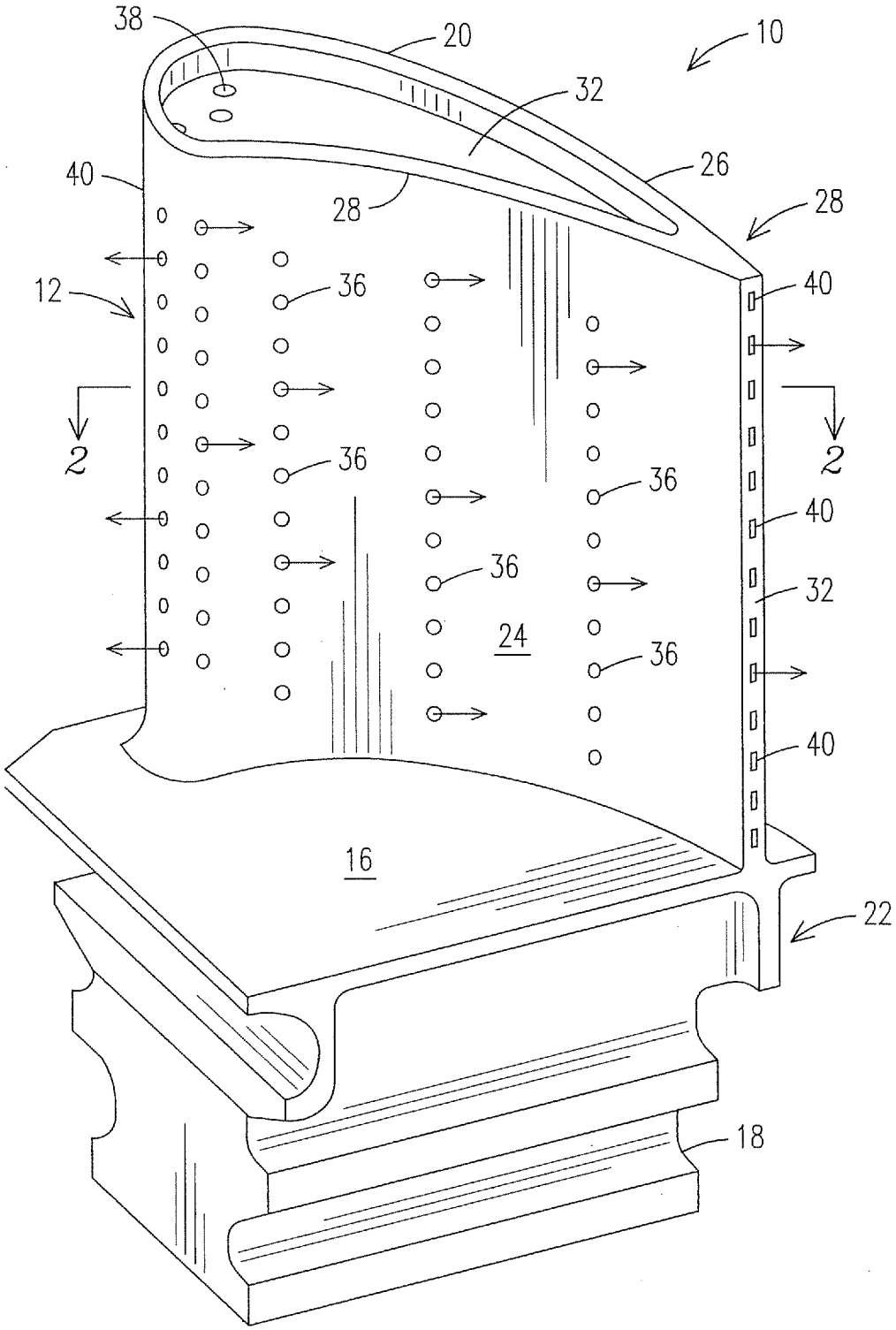
FIG. 1 is an elevation view of a turbine blade incorporating features according to an embodiment of the invention.

This invention is directed to a turbine blade which incorporates a cooling system. Although the invention is applicable to all types of air-foils, FIG. 1 illustrates an engine rotor blade 10 representative of a blade positioned in a first stage of a rotor, disposed immediately downstream from a high pressure turbine nozzle (not shown) through which relatively hot gas generated in a combustor is channeled. The blade 10 includes an airfoil 12 with an internal cooling cavity having a plurality of chambers. The blade 10 includes a platform 16 with an integrally formed dovetail 18 for mounting the blade to a rotor, although in other embodiments the blade could be mounted to a stator. With placement of the blade on a rotor or on a stator, a tip 20 of the blade extends radially outward from the platform 16, with respect to a central axis of the rotor or stator. Generally, the blade extends in a radial direction away from the platform 16. The following description assumes an exemplary orientation consistent with the blade 10 mounted on the rotor.

As shown in FIG. 1, the airfoil has an exterior wall, comprising a concave sidewall 24 and a convex sidewall 26, extending between first and second opposing ends, a first end 22 at which the platform 16 is formed and a second end 28 at which the tip 20 is formed. The concave sidewall 24 defines a pressure surface and the convex sidewall 26 defines a suction surface. The sidewalls 24, 26 are joined together along a leading edge 30, positioned in a region which first receives the hot combustion gases entering the rotor stage, and are joined together along a trailing edge 32 downstream from the leading edge 30 in a region where the hot combustion gases exit the rotor stage. Thus during operation of the turbine a flow of gas passes along the leading edge 30 before passing along the trailing edge 32 of the blade. The concave sidewall 24 includes an interior wall surface 25 and the convex sidewall 26 includes an interior wall surface 27. The cooling chambers extend along portions of the wall surfaces 25, 27.

The blade 10 includes conventional means for circulating relatively cool, compressed air, including channels (not shown) extending through the dovetail 18 and into chambers of the cooling cavity. The cooling chambers may include numerous well known features supplemental to features of the embodiments now described. For example, chambers of the cooling cavities may emit cooling fluid received from the dovetail 18 through cooling apertures 36 formed along the sidewalls 24, 26 to effect film cooling of the pressure and suction surfaces. The cooling air is discharged from the cooling cavity via a series of holes 38 formed along the blade tip 20 and a series of holes 40 formed along the trailing edge 32.

Figure 2:
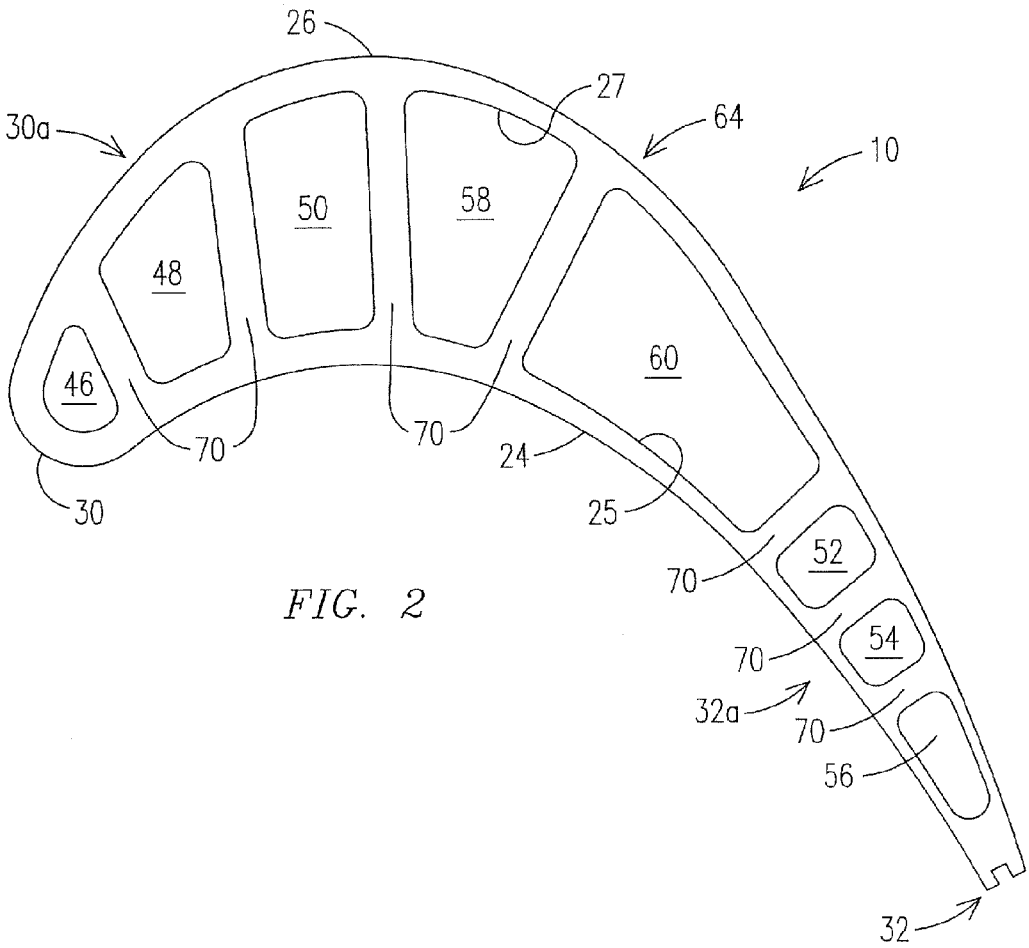
FIG. 2 is a partial view in cross section of the blade shown in FIG. 1.

FIG. 2 is a partial view in cross section of the blade shown in FIG. 1, taken along line 2-2 of FIG. 1, illustrating a series of chambers 46-60 extending from the region 30*a* in which the leading edge 30 is formed to the region 32*a* in which the trailing edge 32 of the blade 10 is formed. The leading edge 30 and the leading edge region 30*a* are relatively thick portions of the blade compared to a relatively thin trailing edge region 32*a* of the blade 10 in which the trailing edge 32 is formed. The illustrated blade 10 includes (i) a series of leading edge chambers 46, 48 positioned along the leading edge 30, a series of trailing edge chambers 52, 54, 56 positioned along the trailing edge 32, and mid region chambers 50, 58, 60 positioned in a mid region 64 of the blade 10 between the leading edge chambers and the trailing edge chambers. Each of the chambers 46-60 extends more or less from the first end 22 to the second end 28 of the blade 10. In the illustrated example the chambers 46-60 are shown to be a serial sequence extending from the leading edge 30 to the trailing edged although other arrangements are contemplated such as, for example, disclosed in U.S. Pat. No. 7,128,533 assigned to the assigned of the present invention and incorporated herein by reference. The chambers 46-60 within the air-foil 12 are defined by a series of wall portions 70 extending between the first and second blade ends 22, 28. Each of the chambers 46-60 is bounded by a portion of one or both interior surfaces 25, 27 and one or more of the wall portions 70.

Figure 3A:
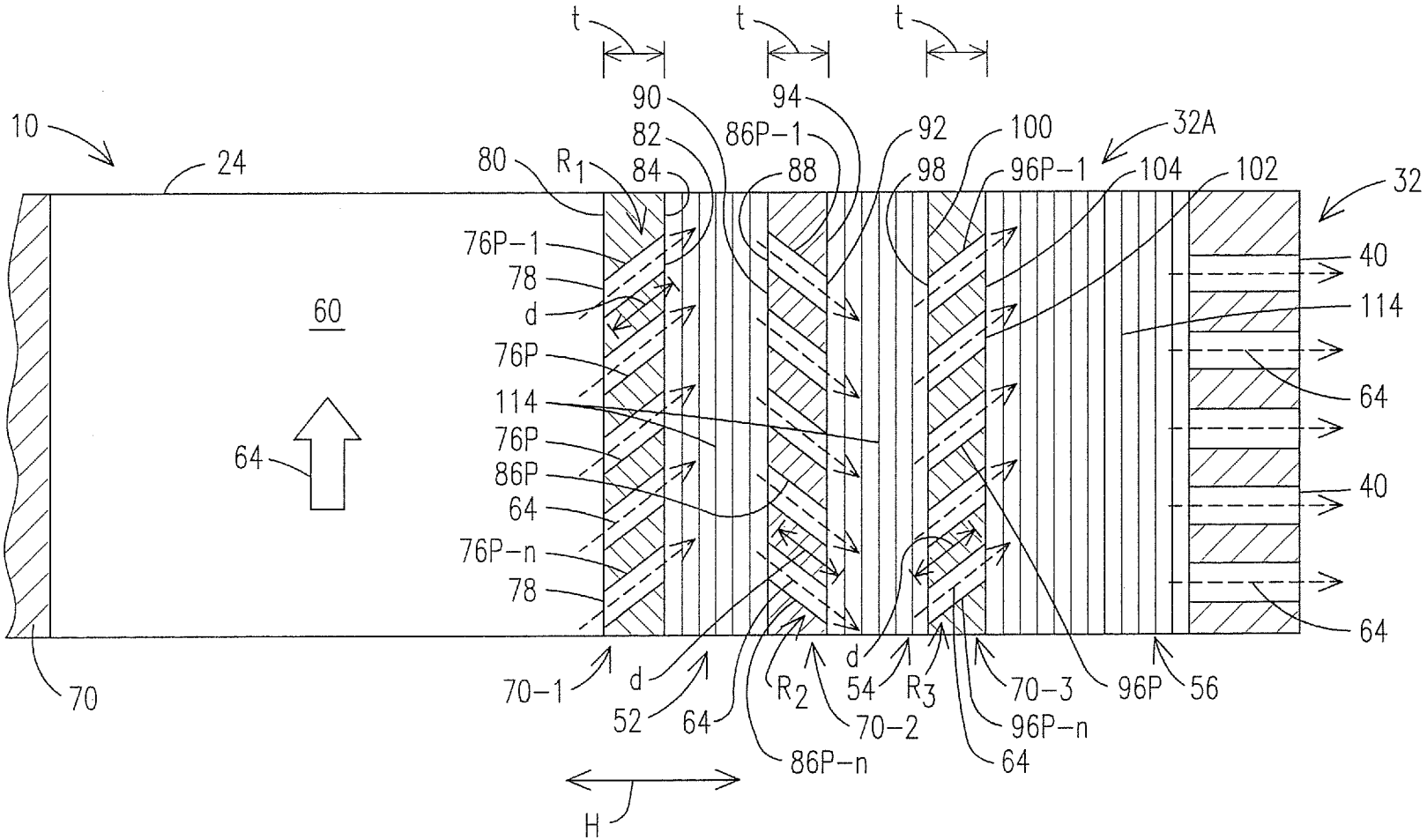
FIGS. 3A and 3B are partial views in cross section of the blade shown in FIG. 1, each illustrating exemplary cooling passages.

FIG. 3A is a partial view in cross section of the blade 10. The partial view corresponds to a view taken along the concave sidewall 24 and through the trailing edge region 32*a*, illustrating the portion of the blade housing the mid region chamber 60 and the trailing edge chambers 52, 54, 56. The view is taken along a plane interior to the airfoil 12 which follows the curvature of the concave sidewall 24 and the flow of air (indicated by arrows) through the trailing edge, passing through cooling paths formed in the wall portions 70 which separate the chambers 60, 52, 54 and 56 from one another. As illustrated in FIG. 3A, for each of the wall portions 70 between the chambers 60, 52, 54 and 56, there is a first series of such passages along the sidewall 24.

Figure 3B:
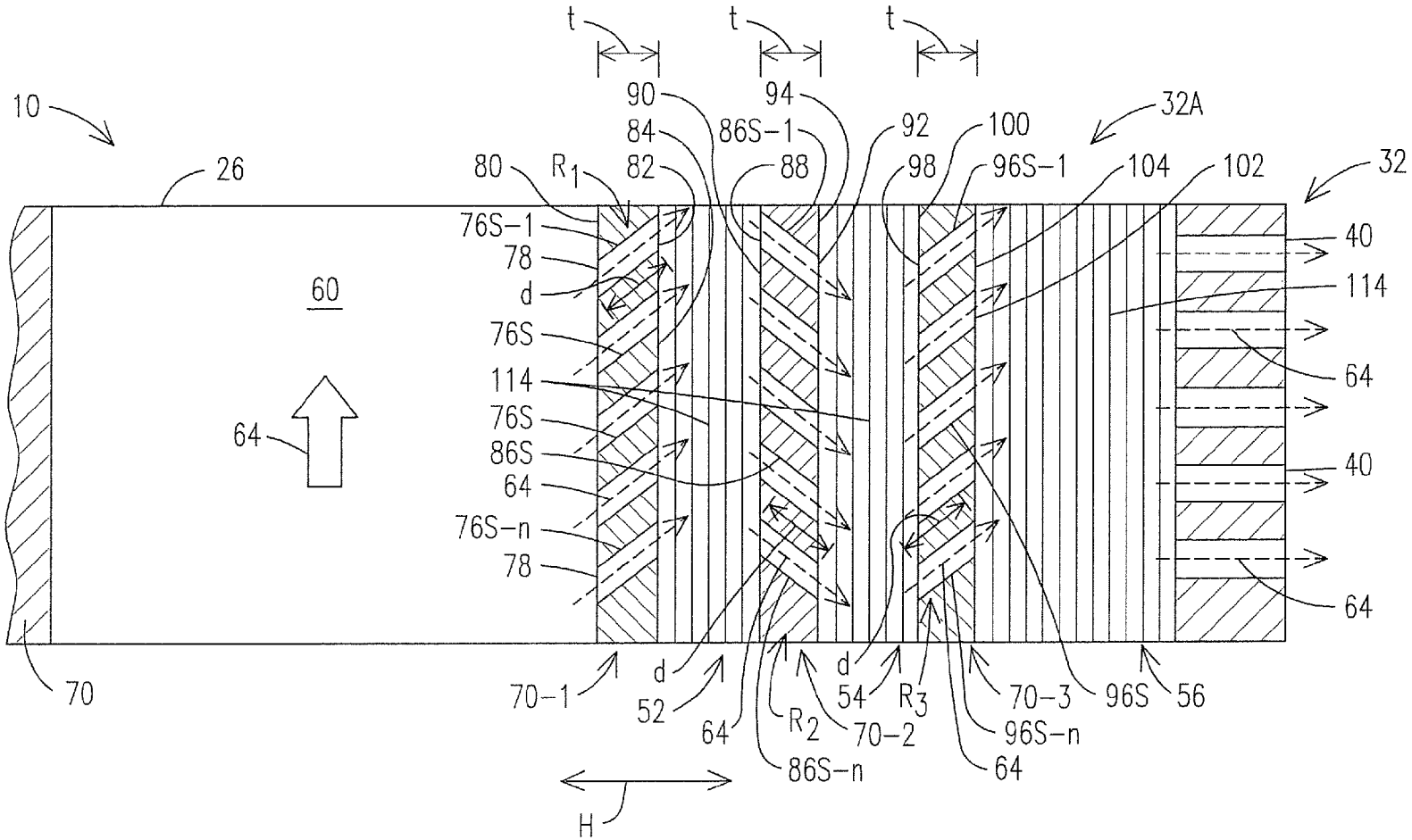

FIG. 3B is another partial view in cross section of the blade 10. The partial view of FIG. 3B corresponds to a view taken along the convex sidewall 26 and through the trailing edge, illustrating a portion of the blade housing the mid region chamber 60 and the trailing edge chambers 52, 54, 56. The view is taken along a plane interior to the airfoil 12 which follows the curvature of the convex sidewall 26 and the flow of air (indicated by arrows) through the trailing edge, passing through cooling paths formed in the wall portions 70 which separate the chambers 60, 52, 54 and 56 from one another. As illustrated in FIG. 3B, for each of the wall portions 70 between the chambers 60, 52, 54 and 56, there is also a second series of such passages along the sidewall 24.

As now described in greater detail, within each wall portion 70 separating the chambers 60, 52, 54 and 56 from one another there are first and second series of passages extending therethrough with each series spaced apart from the other series of passages. For each wall portion, cooling passages in the first series are closer to the concave sidewall 24 than they are close to the convex sidewall 26, and cooling passages in the second series are closer to the convex sidewall 26 than they are close to the concave sidewall 24.

In the illustrated embodiment cooling air flows through the chamber 60 from the platform 16 toward the tip 20 as indicated by an arrow 64. The first and second series of flow paths formed in each of the wall portions 70 positioned between the chambers 60 and 52, between the chambers 52 and 54, and between the chambers 54 and 56, permit the cooling air to travel from the chamber 60 into the chamber 52, then into the chamber 54 and next into the chamber 56. Air (indicated by arrows) traveling through the chamber 56 exits the interior of the air-foil 12 through holes 40 in the trailing edge 32. The trailing edge 32 extends along a direction which corresponds to a radial direction when the blade is mounted on a rotor or stator. A horizontal axis, H, perpendicular to the general direction of the trailing edge 32, is shown in FIGS. 3A and 3B.

A first wall portion between the chambers 60 and 52, designated as wall portion 70-1 includes first and second series of flow paths 76P, 76S. The flow paths 76P in the first series, as shown in FIG. 3A, are closer to the concave sidewall 24 than they are close to the convex sidewall 26. The flow paths 76S in the second series, as shown in FIG. 3B, are closer to the convex sidewall 26 than they are close to the concave sidewall 24. The flow paths 76P and 76S effect fluid communication between the chambers 60 and 52. All of the flow paths 76P and 76S in the wall portion 70-1 are straight paths, each extending from an inlet opening 78 along a first surface 80 of the wall portion 70-1 facing the chamber 60 to an exit opening 82 along a second surface 84 of the wall portion 70-1 which faces the chamber 52. During turbine operation each of the flow paths 76P and 76S receives cooling air from an associated inlet opening 78 in the chamber 60 and transmits the cooling air through the exit opening 80 into the chamber 52.

Each of the flow paths 76P and 76S has a positive slope with respect to the axis H. That is, the slope of each of the straight paths 76P and 76S, as measured from the associated inlet opening 78 to the associated exit opening 82, is a positive slope with respect to the horizontal axis H. Consequently, the exit opening 82 is closer to the blade tip 20 than the inlet opening 78. In other embodiments according to the invention (not illustrated) the flow paths 76P and 76S do not have to be formed as straight paths. They may, for example, be of a spiral shape, in which case they may not have a fixed slope with respect to the axis H. Nor do these paths have to be uniformly distributed in a wall portion.

A second wall portion between the chambers 52 and 54, designated as wall portion 70-2 includes first and second series of flow paths 86P, 86S. The flow paths 86P in the first series, as shown in FIG. 3A, are closer to the concave sidewall 24 than they are close to the convex sidewall 26. The flow paths 86S in the second series, as shown in FIG. 3B, are closer to the convex sidewall 26 than they are close to the concave sidewall 24. The flow paths 86P and 86S effect fluid communication between the chambers 52 and 54. All of the flow paths 86P and 86S in the wall portion 70-2 are straight paths, each extending from an inlet opening 88 along a first surface 90 of the wall portion 70-2 facing the chamber 52 to an exit opening 92 along a second surface 94 of the wall portion 70-2 which faces the chamber 52. During turbine operation each of the flow paths 86S and 86P receives cooling air from an associated inlet opening 88 in the chamber 52 and transmits the cooling air through the exit opening 92 into the chamber 54.

Each of the flow paths 86P and 86S has a negative slope with respect to the axis H. That is, the slope of each of the straight paths 86P and 86S, as measured from the associated inlet opening 88 to the associated exit opening 92, is a negative slope with respect to the horizontal axis H. Consequently, inlet opening 88 is closer to the blade tip 20 than the exit opening 92. In other embodiments according to the invention (not illustrated) the flow paths 86P and 86S do not have to be formed as straight paths. They may, for example, be of a spiral shape, in which case they may not have a fixed slope with respect to the axis H. Nor do these paths have to be uniformly distributed in a wall portion.

A third wall portion between the chambers 54 and 56, designated as wall portion 70-3 includes first and second series of flow paths 96P, 96S. The flow paths 96P in the first series, as shown in FIG. 3A, are closer to the concave sidewall 24 than they are close to the convex sidewall 26. The flow paths 96S in the second series, as shown in FIG. 3B, are closer to the convex sidewall 26 than they are close to the concave sidewall 24. The flow paths 96P and 96S effect fluid communication between the chambers 54 and 56. The flow paths 96P and 96S effect fluid communication between the chambers 54 and 56. All of the flow paths 96P and 96S in the wall portion 70-3 are straight paths, each extending from an inlet opening 98 along a first surface 100 of the wall portion 70-3 facing the chamber 54 to an exit opening 102 along a second surface 104 of the wall portion 70-3 which faces the chamber 56. During turbine operation each of the flow paths 96P and 96S receives cooling air from an associated inlet opening in the chamber 54 and transmits the cooling air through the exit opening 102 into the chamber 56.

Each of the flow paths 96P and 96S has a positive slope with respect to the axis H. That is, the slope of each of the straight paths 96P and 96S, as measured from the associated inlet opening 98 to the associated exit opening 102, is a positive slope with respect to the horizontal axis H. Consequently, the exit opening 102 is closer to the blade tip 20 than the inlet opening 98. In other embodiments according to the invention (not illustrated) the flow paths 96P and 96S do not have to be formed as straight paths. They may, for example, be of a spiral shape, in which case they may not have a fixed slope with respect to the axis H. Nor do these paths have to be uniformly distributed in a wall portion.

The first series of the flow paths 76P is positioned through the wall portion 70-1 and adjacent the concave sidewall 24, and the second series of the flow paths 76S is positioned through the wall portion 70-1 and adjacent the convex sidewall 26. The first series of paths 76P is positioned between the concave sidewall 24 and the second series of paths 76S. The second series of paths 76S is positioned between the convex sidewall 26 and the first series of paths 76P. Each of the two series of flow paths 76P, 76S comprises an arbitrary number of paths which each extend between the first and second ends 22, 28 of the blade 10 in a direction generally perpendicular to the horizontal axis H. A first in the series of flow paths 76P, closest to the second end 28, is designated path 76P-1 and a last in the series of flow paths 76P, closest to the first end 22, is designated path 76P-n. The path 76P-1 passes through a region, $R_1$, of the wall portion 70-1. Similarly, a first in the series of flow paths 76S, closest to the second end 28, is designated path 76S-1 and a last in the series of flow paths 76S, closest to the first end 22, is designated path 76S-n. The path 76S-1 also passes through the region, $R_1$, of the wall portion 70-1.

The first series of the flow paths 86P is positioned through the wall portion 70-2 and adjacent the concave sidewall 24, and the second series of the flow paths 86S is positioned through the wall portion 70-2 and adjacent the convex sidewall 26. The first series of paths 86P is positioned between the concave sidewall 24 and the second series of paths 86S. The second series of paths 86S is positioned between the convex sidewall 26 and the first series of paths 86P. Each of the two series of flow paths 86P, 86S comprises an arbitrary number of paths which each extend between the first and second ends 22, 28 of the blade 10 in a direction generally perpendicular to the horizontal axis H. A first in the series of flow paths 86P, closest to the second end 28, is designated path 86P-1 and a last in the series of flow paths 86P, closest to the first end 22, is designated path 86P-n. Similarly, a first in the series of flow paths 86S, closest to the second end 28, is designated path 86S-1 and a last in the series of flow paths 86S, closest to the first end 22, is designated path 86S-n.

The first series of the flow paths 96P is positioned through the wall portion 70-3 and adjacent the concave sidewall 24, and the second series of the flow paths 96S is positioned through the wall portion 70-3 and adjacent the convex sidewall 26. The first series of paths 96P is positioned between the concave sidewall 24 and the second series of paths 96S. The second series of paths 96S is positioned between the convex sidewall 26 and the first series of paths 96P. Each of the two series of flow paths 96P, 96S comprises an arbitrary number of paths which each extend between the first and second ends 22, 28 of the blade 10 in a direction generally perpendicular to the horizontal axis H. A first in the series of flow paths 96P, closest to the second end 28, is designated path 96P-1 and a last in the series of flow paths 96P, closest to the first end 22, is designated path 96P-n. Similarly, a first in the series of flow paths 96S, closest to the second end 28, is designated path 96S-1 and a last in the series of flow paths 96S, closest to the first end 22, is designated path 96S-n.

It can be seen from the example design shown in FIGS. 3A and 3B that adjacent members in different series of paths form a zig zag pattern. For example, the sequence of paths 76P-1, 86P-1 and 96P-1 forms a pressure side zig zag zig pattern through which cooling air can flow from the chamber 60 to the chamber 56 and out a hole 40 of the trailing edge 32. Similarly, the sequence of paths 76S-1, 86S-1 and 96S-1 forms a suction side zig zag zig pattern through which cooling air can flow from the chamber 60 to the chamber 56 and out a hole 40 of the trailing edge 32.

Figure 4A:
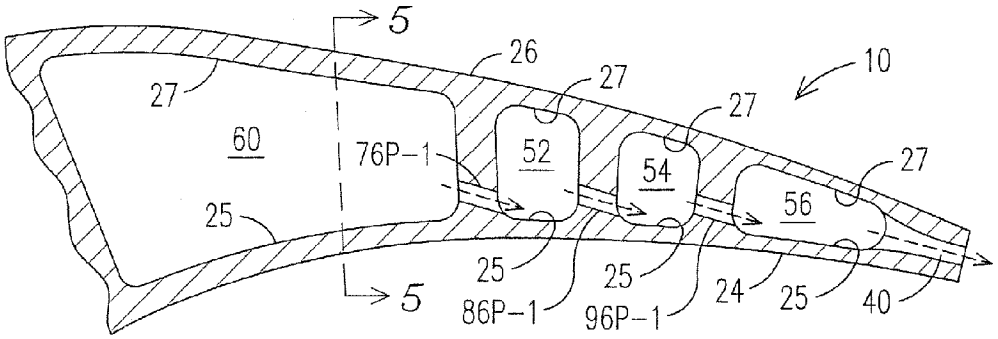
FIGS. 4A and 4B are cross sections taken through multiple chambers in an exemplary design of a trailing edge according to an embodiment of the invention.
Figure 4B:
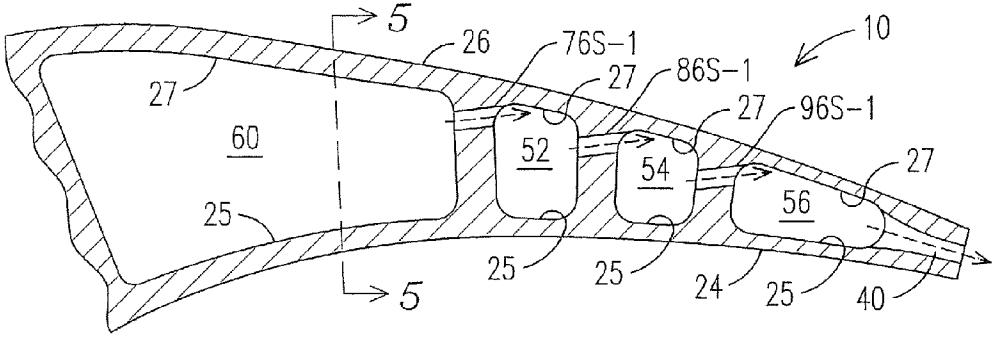

FIGS. 4A and 4B illustrate exemplary and complementary orientations of three pairs of flow paths between the chambers 60, 52, 54 and 56. FIG. 4A illustrates three flow paths between the chambers 60, 52, 54 and 56, each illustrated flow path being in one of the three series 76P, 86P, 96P. FIG. 4B illustrates three flow paths between the chambers 60, 52, 54 and 56, each illustrated flow path being in one of the three series 76S, 86S and 96S. FIG. 4A is a view in cross section taken from the tip 20 of the blade 10 along a flow path of cooling air shown in FIG. 3A to illustrate an orientation of one zig zag zig sequence of the flow paths 76P-1, 86P-1 and 96P-1. Each illustrated path is positioned between the concave sidewall 24 and one of the three second series of paths 76S, 86S, 96S. As shown in FIG. 4A for the illustrated paths 76P-1, 86P-1 and 96P-1, all of the flow paths 768P, 86SP, 96SP are formed at an angle with respect to the concave sidewall 24 such that the exit opening 82 is closer to the sidewall 24 than the inlet opening 78. FIG. 4B is a second view in cross section taken from the tip 20 of the blade 10 along a flow path of cooling air shown in FIG. 3B to illustrate an exemplary orientation of one zig zag zig sequence of flow paths 76S-1, 86S-1 and 96S-1. Each illustrated path is positioned between the convex sidewall 26 and one of the three first series of paths 76P, 86P and 96P. As shown in FIG. 3B for the illustrated paths 76S-1, 86S-1, 96S-1, all of the flow paths 76S, 86S, 96S are formed at an angle with respect to the convex sidewall 24 such that the exit opening 82 is closer to the suction sidewall 26 than the inlet opening 78. This slanted orientation causes cooling air which passes through the exit opening 82 to impinge upon the interior wall surfaces 25, 27 to facilitate heat transfer from the sidewalls 24, 26.

Portions of the interior wall surfaces 25, 27 which form walls of the trailing edge chambers 52, 54, 56 may be textured surfaces to enhance heat transfer between the sidewalls 24, 26 and the cooling gas. The textured surfaces may be formed with a series of grooves, ribs, fluting, or even a mesh-like design wherein a crisscrossed pattern of ribs protrude from the sidewalls into the chambers. In the example embodiment of FIGS. 3A and 3B the surfaces 25 and 27 include grooves 114 which extend along the surfaces in a direction perpendicular to the axis H.

Figure 5:
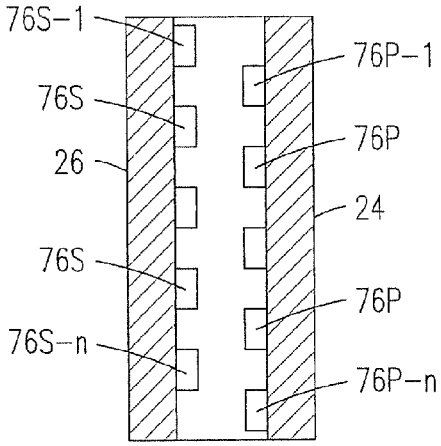
FIG. 5 is an elevation view of the chambers of the trailing edge taken along lines 4-4 of FIGS. 4A and 4B.

FIG. 5 is an elevation view of the turbine 10 of FIGS. 4A and 4B taken along lines 5-5 thereof illustrating a staggered arrangement of the inlet openings 78 of the first and second cooling paths 76P, 76S. The paths in each series are shown in FIG. 3 as uniformly spaced apart and the inlet openings 78 to the paths in each series are shown as uniformly spaced apart. Thus, with the inlet opening of the suction side cooling path 76S-1 positioned closer to the tip 20, the entire series of cooling paths 76S is in a staggered relationship with respect to the entire series of cooling paths 76P. Further, the entire series of cooling paths 86S is in a staggered relationship with respect to the entire series of cooling paths 86P and the entire series of cooling paths 96S is in a staggered relationship with respect to the entire series of cooling paths 96P.

A feature of the invention is that the path length, e.g., a distance, d, as may be measured along each cooling path 76P, 76S from the inlet opening 78 to the exit opening 82 is a distance greater than the thickness, t, of the region of the wall portion through which it is formed. Reference to such a thickness means the minimum distance across the wall portion as measured between two adjacent chambers (e.g., in a region, $R_1$, of the wall portion 70-1 between the inlet opening 78 and the exit opening 82 of the cooling path 76P-1 or 76S-1) such that the length of the path which the cooling air travels, between two adjacent chambers (e.g., chambers 60 and 52), is being compared with the thickness of the wall portion.

Similarly, a distance, d, as may be measured along each cooling path 86P, 86S from the inlet opening 88 to the exit opening 92 is a distance greater than the thickness, t, of the region of the wall portion through which it is formed. Reference to such a thickness means the minimum distance across the wall portion as measured between two adjacent chambers (e.g., in a region, $R_2$, of the wall portion 70-2 between the inlet opening 88 and the exit opening 92 of the cooling path 86P-n or 86S-n) such that the length of the path which the cooling air travels, between two adjacent chambers (e.g., chambers 52 and 54), is being compared with the thickness of the wall portion.

A distance, d, as may be measured along each cooling path 96P, 96S from the inlet opening 98 to the exit opening 102 is a distance greater than the thickness, t, of the region of the wall portion through which it is formed. Reference to such a thickness means the minimum distance across the wall portion as measured between two adjacent chambers (e.g., in a region, $R_3$, of the wall portion 70-3 between the inlet opening 98 and the exit opening 102 of the cooling path 96P-n or 96S-n) such that the length of the path which the cooling air travels, between two adjacent chambers (e.g., chambers 54 and 56), is being compared with the thickness of the wall portion.

In the illustrated embodiment this feature is had by forming straight paths through the wall portions with the straight paths each having a slope with respect to the axis H. In other embodiments the greater distance can be effected by forming the cooling path with numerous other shapes, including a winding shape, such as a helix or serpentine pattern or with a saw tooth or sinusoidal shape or with various combinations of the foregoing. The path length through a wall portion along a trailing edge, as may be measured from the inlet opening to the exit opening may be at least five percent greater than the thickness of the region of the wall portion through which it is formed.

Figure 6:
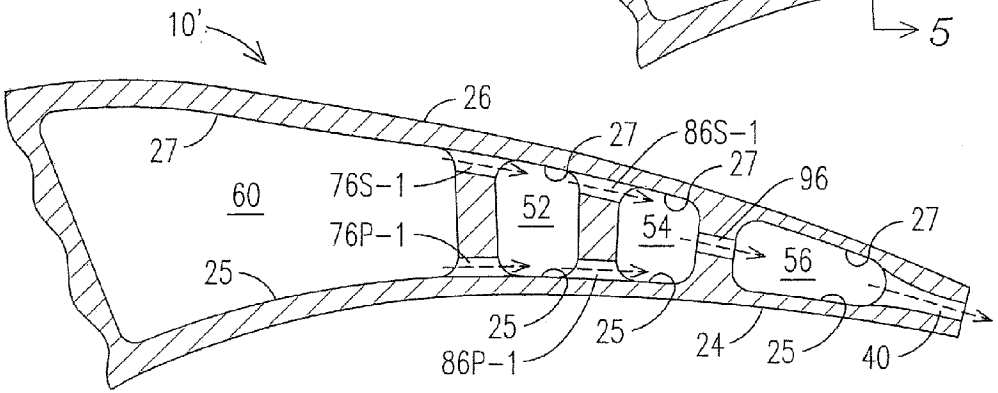
FIG. 6 is another view in cross section which illustrates a blade according to an alternate embodiment of the invention.

FIG. 6 illustrates an alternate embodiment of a blade according to the invention wherein like reference numbers refer to features described in the preceding figures. A blade 10' has two pairs of flow paths between the chambers 60, 52 and 54, each illustrated flow path being in one of the two series 76P, 86P or in one of the two series 76S, 86S.

Unlike the embodiment shown in FIGS. 3 and 4, for the blade 10' the series of cooling paths 76S is not in a staggered relationship with respect to the series of cooling paths 76P and the series of cooling paths 86S is not in a staggered relationship with respect to the series of cooling paths 86P. Further, unlike the embodiment shown in FIGS. 3 and 4, for the blade 10' members in the series of cooling paths 76S are not impinging on the suction sidewall and members in the series of cooling paths 76P are not impinging on the pressure sidewall; and members in the series of cooling paths 86S are not impinging on the suction sidewall and members in the series of cooling paths 86P are not impinging on the pressure sidewall. Rather, the view in cross section of FIG. 6, taken from the tip 20 of the blade 10, illustrates two parallel flow paths of cooling air each having one zig zag sequence after which the wall portion 70-3 contains only one central series of flow paths 96 in lieu of the two series 96P and 96S of cooling paths. That is, cooling air arriving in the chamber 54 from two different series of cooling paths 86P and 86S is merged into one series of cooling paths 96. The view of FIG. 6 illustrates one flow path in each series (i.e., 76P-1, 76S-1, 86P-1, 86S-1 and 96), it being understood that there may be n such flow paths in each of the series.

Also, as shown in FIG. 6, for the blade 10' none of the illustrated paths 76P-1, 76S-1, 86P-1, 86S-1 and 96 are formed at an angle with respect to the concave sidewall 24 or the convex sidewall 26, i.e., the exit opening 82 is not closer to one of the sidewalls 24, 26 than the inlet opening 78. In still other embodiments some of the cooling paths may be formed at an angle with respect to the concave sidewall 24 or the convex sidewall 26, while other ones of the cooling paths (i.e., in the same series or in a different series of paths) are not formed at an angle with respect to the adjoining sidewall 24, 26.

While embodiments of the present invention have been described, these are provided by way of example only. Many modifications and changes will be apparent to those skilled in the art. Numerous variations, changes and substitutions may be made without departing from the invention herein. The blade may comprise at least one leading edge chamber extending between the first and second airfoil ends in the relatively thick leading edge region, and at least first and second trailing edge chambers each extending between the first and second airfoil ends in the relatively thin trailing edge region, the airfoil including multiple interior wall portions, each extending between the first and second opposing ends, each wall portion separating at least one chamber from another one of the chambers. Accordingly, it is intended that the invention be limited only by the spirit and scope of the appended claims.

The claimed invention is:

1. A blade positionable about an axis of rotation in a gas turbine engine, the blade being of the type having a relatively thick leading edge and a relatively thin trailing edge wherein, when the blade is mounted to a rotor or stator during operation of the engine, a flow of fluid passes along the leading edge before passing along the trailing edge, the blade comprising:

an airfoil having first and second opposing ends, the airfoil extending between a tip at the first end and a platform at the second end, the airfoil including an exterior wall extending between the tip and the platform, the exterior wall comprising a concave sidewall joined to a convex sidewall, with each sidewall extending from the relatively thick leading edge region of the airfoil to the relatively thin trailing edge region of the airfoil, the blade comprising (i) at least one leading edge chamber extending between the first and second airfoil ends in the relatively thick leading edge region, and (ii) at least first and second trailing edge chambers each extending between the first and second airfoil ends in the relatively thin trailing edge region, the airfoil including multiple interior wall portions, each extending between the first and second opposing ends, each wall portion separating at least one chamber from another one of the chambers, wherein:

(a) the trailing edge is an edge of the airfoil which extends in a first direction toward the first end, (b) a first of the wall portions is positioned between the first and second trailing edge chambers and comprises (i) a first plurality of flow paths adjacent the concave sidewall and extending through the first wall portion from the first trailing edge chamber to the second trailing edge chamber and (ii) a second plurality of flow paths adjacent the convex sidewall and also extending through the first wall portion from the first trailing edge chamber to the second trailing edge chamber, the first plurality of paths positioned between the concave sidewall and the second plurality of paths, and the second plurality of paths positioned between the convex sidewall and the first plurality of paths, each of the flow paths extending from an inlet opening in the first trailing edge chamber for receiving fluid from the first trailing edge chamber to an exit opening in the second trailing edge chamber for passing the fluid into the second chamber, (c) the first wall portion includes a first region having a first thickness measurable as a distance between the first and second chambers and one of the paths extends a first path distance, through the first region, as measured from the associated path opening in the first chamber, through the first region and to the exit opening in the second chamber which path distance is greater than the first thickness, (d) with respect to both the first direction and the trailing edge, said one of the paths through the first region is a straight path having a non-zero slope whereby the inlet opening of said one of the paths through the first region is closer to the tip than the exit opening of said one of the paths, or the exit opening of said one of the paths is closer to the tip than the inlet opening of said one of the paths, (e) the blade further comprises a third trailing edge chamber extending between the first and second airfoil ends in the relatively thin trailing edge region with a second of the wall portions between the second and third trailing edge chambers, the second wall portion including:

(i) a third plurality of flow paths adjacent the concave sidewall and extending through the second wall portion from the second trailing edge chamber to the third trailing edge chamber and (ii) a fourth plurality of flow paths adjacent the convex sidewall and also extending through the second wall portion from the second trailing edge chamber to the third trailing edge chamber, the third plurality of paths positioned between the concave sidewall and the fourth plurality of paths, and the fourth plurality of paths positioned between the convex sidewall and the third plurality of paths, each of the flow paths of the third and fourth pluralities of paths extending from an inlet opening in the second trailing edge chamber for receiving fluid from the second trailing edge chamber to an exit opening in the third trailing edge chamber for passing the fluid into the third chamber, (f) the second wall portion includes a second region having a second thickness measurable as a distance between the second and third chambers and one of the paths extends a second path distance, through the second wall portion, as measured from the associated path opening in the second chamber, through the second region and to the exit opening in the third chamber which second path distance is greater than the second thickness, (g) with respect to both the first direction and the trailing edge, said one of the paths through the second region is a straight path having a non-zero slope, whereby the inlet opening of said one of the paths through the second region is closer to the tip than the exit opening of said one of the paths through the second region, or the exit opening of said one of the paths through the second region is closer to the tip than the inlet opening of said one of the paths through the second region, and:

the slope of the straight path through the first region, as measured from the associated inlet opening to the associated exit opening is a positive slope with respect to the first direction, and the slope of the straight path through the second region, as measured from the associated inlet opening to the associated exit opening is a negative slope with respect to the first direction; or the slope of the straight path through the first region, as measured from the associated inlet opening to the associated exit opening is a negative slope with respect to the first direction, and the slope of the straight path through the second region, as measured from the associated inlet opening to the associated exit opening is a positive slope with respect to the first direction.

2. The blade of claim 1 wherein the first thickness is the maximum thickness of the first region.

3. The blade of claim 1 wherein the first region is of a uniform thickness.

4. The blade of claim 1 wherein the first path distance is at least five percent greater than the first thickness.

5. The blade of claim 1 wherein the first thickness of the first region is a maximum thickness of the first region and the second thickness of the second region is a maximum thickness of the second region, and said one of the paths through the second region is a straight path.

6. The blade of claim 1 wherein the first region of the first wall portion is of a uniform thickness, the second region of the second wall portion is of a uniform thickness, and said one of the paths through the second region is a straight path.

7. The blade of claim 1 wherein the first path distance is at least five percent greater than the first thickness and the second path distance is at least five percent greater than the second thickness.

8. The blade of claim 1 wherein the trailing edge of the airfoil is a portion of the exterior blade wall positioned between the third trailing edge chamber and a region exterior to the blade and the trailing edge includes a fifth plurality of flow paths providing a passage through which fluid passing through the first, second and third trailing edge chambers can exit the blade.

9. The blade of claim 1 wherein the concave sidewall includes a surface in one of the trailing edge chambers a portion of which is textured to facilitate heat transfer between the concave sidewall and fluid flowing through the chamber.

10. The blade of claim 9 wherein the convex sidewall includes a surface in one of the trailing edge chambers a portion of which is textured to facilitate heat transfer between the convex sidewall and fluid flowing through the chamber.

11. The blade of claim 1 wherein the convex sidewall includes a surface in one of the trailing edge chambers a portion of which is textured to facilitate heat transfer between the convex sidewall and fluid flowing through the chamber.

12. The blade of claim 1 wherein one of the sidewalls of the blade includes a surface in one of the trailing edge chambers a portion of which has grooves or ribs or a fluted surface along which fluid flowing through the chamber may pass.

13. The blade of claim 1 wherein for one in the first plurality of flow paths the associated exit opening is closer to the concave sidewall than the associated inlet opening.

14. The blade of claim 1 wherein for one in the second plurality of flow paths the associated exit opening is closer to the convex sidewall than the associated inlet opening.

15. A blade positionable about an axis of rotation in a gas turbine engine, the blade being of the type having a relatively thick leading edge and a relatively thin trailing edge wherein, when the blade is mounted to a rotor or stator during operation of the engine, a flow of fluid passes along the leading edge before passing along the trailing edge, the blade comprising:

an airfoil having first and second opposing ends, the airfoil extending between a tip at the first end and a platform at the second end, the airfoil including an exterior wall extending between the tip and the platform, the exterior wall comprising a concave sidewall joined to a convex sidewall, with each sidewall extending from the relatively thick leading edge region of the airfoil to the relatively thin trailing edge region of the airfoil, the blade comprising (i) at least one leading edge chamber extending between the first and second airfoil ends in the relatively thick leading edge region, and (ii) at least first and second trailing edge chambers each extending between the first and second airfoil ends in the relatively thin trailing edge region, the airfoil including multiple interior wall portions, each extending between the first and second opposing ends, each wall portion separating at least one chamber from another one of the chambers, wherein:

a first of the wall portions is positioned between the first and second trailing edge chambers and comprises (i) a first plurality of flow paths adjacent the concave sidewall and extending through the first wall portion from the first trailing edge chamber to the second trailing edge chamber and (ii) a second plurality of flow paths adjacent the convex sidewall and also extending through the first wall portion from the first trailing edge chamber to the second trailing edge chamber, the first plurality of paths positioned between the concave sidewall and the second plurality of paths, and the second plurality of paths positioned between the convex sidewall and the first plurality of paths, each of the flow paths extending from an inlet opening in the first trailing edge chamber for receiving fluid from the first trailing edge chamber to an exit opening in the second trailing edge chamber for passing the fluid into the second chamber, the first wall portion includes a first region having a first thickness measurable as a distance between the first and second chambers and one of the paths extends a first path distance as measured from the associated path opening in the first chamber, through the first region and to the exit opening in the second chamber which path distance is greater than the first thickness, wherein the trailing edge is an edge of the airfoil which extends in a first direction toward the first end and, with respect to both the first direction and the trailing edge, each in the first plurality of flow paths or each in the second plurality of flow paths is a straight path extending through the first region and having a non-zero slope as measured from the inlet opening to the exit opening whereby, for each in the first plurality of flow paths or for each in the second plurality of flow paths: the inlet opening is closer to the tip than the exit opening, or the exit opening is closer to the tip than the inlet opening and wherein:

(a) the blade further comprises a third trailing edge chamber extending between the first and second airfoil ends in the relatively thin trailing edge region with a second of the wall portions between the second and third trailing edge chambers, the second wall portion including:

(i) a third plurality of flow paths adjacent the concave sidewall and extending through the second wall portion from the second trailing edge chamber to the third trailing edge chamber and (ii) a fourth plurality of flow paths adjacent the convex sidewall and also extending through the second wall portion from the second trailing edge chamber to the third trailing edge chamber, the third plurality of paths positioned between the concave sidewall and the fourth plurality of paths, and the fourth plurality of paths positioned between the convex sidewall and the third plurality of paths, each of the flow paths of the third and fourth pluralities of paths extending from an inlet opening in the second trailing edge chamber for receiving fluid from the second trailing edge chamber to an exit opening in the third trailing edge chamber for passing the fluid into the third chamber, (b) the second wall portion includes a second region having a second thickness measurable as a distance between the second and third chambers and one of the paths extends a second path distance, through the second wall portion, as measured from the associated path opening in the second chamber, through the second region and to the exit opening in the third chamber which second path distance is greater than the second thickness, (c) with respect to both the first direction and the trailing edge, said one of the paths through the second region is a straight path having a non-zero slope whereby—for each in the third plurality of flow paths or for each in the fourth plurality of flow paths: the inlet opening is closer to the tip than the exit opening, or the exit opening is closer to the tip than the inlet opening, and:

(i) the slope of a straight path through the first region, as measured from the associated inlet opening to the associated exit opening is a positive slope with respect to the first direction, and the slope of the straight path through the second region, as measured from the associated inlet opening to the associated exit opening is a negative slope with respect to the first direction and with respect to the straight path extending through the first region; or (ii) the slope of a straight path through the first region, as measured from the associated inlet opening to the associated exit opening is a negative slope with respect to the first direction, and the slope of the straight path through the second region, as measured from the associated inlet opening to the associated exit opening is a positive slope with respect to the first direction and with respect to the straight path extending through the first region.

* * * * *